US007457556B2

(12) United States Patent
Sekiguchi et al.

(10) Patent No.: US 7,457,556 B2
(45) Date of Patent: Nov. 25, 2008

(54) IMAGE FORMING APPARATUS FORMING IMAGES USING LIGHT AND DARK TONERS AND CONTROL METHOD THEREOF

(75) Inventors: Nobuo Sekiguchi, Moriya (JP); Hirokazu Kodama, Ryugasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 274 days.

(21) Appl. No.: 11/281,094

(22) Filed: Nov. 17, 2005

(65) Prior Publication Data

US 2006/0110176 A1 May 25, 2006

(30) Foreign Application Priority Data

Nov. 19, 2004 (JP) ..... 2004-336153

(51) Int. Cl.
*G03G 15/08* (2006.01)
*G03G 15/00* (2006.01)

(52) U.S. Cl. ..... 399/53; 399/49

(58) Field of Classification Search ..... 399/49, 399/53, 54, 60, 72

See application file for complete search history.

(56) References Cited

U.S. PATENT DOCUMENTS 6,498,910 B2 12/2002 Haneda

FOREIGN PATENT DOCUMENTS

| | | | |
|---|---|---|---|
| JP | 02-012167 | | 1/1990 |
| JP | 06-270421 | | 9/1994 |
| JP | 2001-191589 | * | 7/2001 |
| JP | 2001-290319 | | 10/2001 |
| JP | 2003-300312 | | 10/2003 |

* cited by examiner

*Primary Examiner*—Hoang Ngo

(74) *Attorney, Agent, or Firm*—Canon USA Inc. IP Div

(57) ABSTRACT

An image forming apparatus performing development using light toner of a first color and dark toner of the first color includes a control unit configured to control tone in order to set gradation characteristics of an image developed with the light toner; a determination unit configured to determine whether the gradation characteristics of the light toner image are in a desirable state as a result of the tone control by the control unit; and a shift unit configured to shift an area where mixture of the light toner with the dark toner is started, the area corresponding to the desirable state, responsive to the determination unit determining that the gradation characteristics of the light toner image are not in the desirable state.

2 Claims, 14 Drawing Sheets

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| | | | | | | | | | | | | | | | | | | | | | | | | | | | | | | | 128 |
| | | | | | | | | | | | | | | | | | | | | | | | | | | | | | | 136 | 120 |
| | | | | | | | | | | | | | | | | | | | | | | | | | | | | | 144 | 128 | 112 |
| | | | | | | | | | | | | | | | | | | | | | | | | | | | | 152 | 136 | 120 | 104 |
| | | | | | | | | | | | | | | | | | | | | | | | | | | | 160 | 144 | 128 | 112 | 96 |
| | | | | | | | | | | | | | | | | | | | | | | | | | | 168 | 152 | 136 | 120 | 104 | 88 |
| | | | | | | | | | | | | | | | | | | | | | | | | | 176 | 160 | 144 | 128 | 112 | 96 | 80 |
| | | | | | | | | | | | | | | | | | | | | | | | | 184 | 168 | 152 | 136 | 120 | 104 | 88 | 72 |
| | | | | | | | | | | | | | | | | | | | | | | | 192 | 176 | 160 | 144 | 128 | 112 | 96 | 80 | 64 |
| | | | | | | | | | | | | | | | | | | | | | | 200 | 184 | 168 | 152 | 136 | 120 | 104 | 88 | 72 | 56 |
| | | | | | | | | | | | | | | | | | | | | | 208 | 192 | 176 | 160 | 144 | 128 | 112 | 96 | 80 | 64 | 48 |
| | | | | | | | | | | | | | | | | | | | 216 | 200 | 184 | 168 | 152 | 136 | 120 | 104 | 88 | 72 | 56 | 40 | 24 |
| | | | | | | | | | | | | | | | | | 224 | 208 | 192 | 176 | 160 | 144 | 128 | 112 | 96 | 80 | 64 | 48 | 32 | 16 | 0 |
| | | | | | | | | | | | | | | | | 232 | 216 | 200 | 184 | 168 | 152 | 136 | 120 | 104 | 88 | 72 | 56 | 40 | 24 | 8 | |
| | | | | | | | | | | | | | | 240 | 224 | 208 | 192 | 176 | 160 | 144 | 128 | 112 | 96 | 80 | 64 | 48 | 32 | 16 | | | |
| | | | | | | | | | | | | 248 | 232 | 216 | 200 | 184 | 168 | 152 | 136 | 120 | 104 | 88 | 72 | 56 | 40 | 24 | 8 | | | | |
| | | | | | | | | | | | 256 | 240 | 224 | 208 | 192 | 176 | 160 | 144 | 128 | 112 | 96 | 80 | 64 | 48 | 32 | 16 | 0 | | | | |

FIG. 10

| i | −5 | −4 | −3 | −2 | −1 | 0 | 1 | 2 | 3 | 4 | 5 |
|---|---|---|---|---|---|---|---|---|---|---|---|
| VL | 550 | 540 | 530 | 520 | 510 | 500 | 490 | 480 | 470 | 460 | 450 |
| VD | 1750 | 1800 | 1850 | 1900 | 1950 | 2000 | 2050 | 2100 | 2150 | 2200 | 2250 |

FIG. 15

| IMAGE DATA | 0 | 8 | 16 | 24 | ··· | 104 | 112 | 120 | 128 | 136 | ··· | 208 | 216 | 224 | 232 | 240 | 248 | 256 |
|---|---|---|---|---|---|---|---|---|---|---|---|---|---|---|---|---|---|---|
| LIGHT IMAGE DATA | 0 | 8 | 16 | 24 | ··· | 104 | 112 | 104 | 96 | 88 | ··· | 16 | 8 | 0 | 0 | 0 | 0 | 0 |
| DARK IMAGE DATA | 0 | 0 | 0 | 0 | ··· | 0 | 0 | 16 | 32 | 48 | ··· | 192 | 208 | 224 | 232 | 240 | 248 | 256 |

IMAGE FORMING APPARATUS FORMING IMAGES USING LIGHT AND DARK TONERS AND CONTROL METHOD THEREOF

BACKGROUND OF THE INVENTION

1. Field of the Invention

The present invention relates to an image forming apparatus that forms images with toners having approximately the same color but having different densities and to a control method of the information processing apparatus.

2. Description of the Related Art

A typical image forming apparatus forming images by electrophotography includes a charging unit that uniformly charges the photosensitive surface of a photosensitive drum. The image forming apparatus also includes a latent image forming unit that forms an electrostatic latent image on the charged photosensitive surface in accordance with image information, a developing unit that develops the electrostatic latent image, a transfer unit that transfers the developed latent image on a recording material, and a fixing unit that fixes the transferred image on the recording material.

One kind of toner (developer) having a predetermined density has generally been used for every color, such as, cyan, magenta, yellow, or black. However, when one kind of toner having a predetermined density is used, the amount of toner falls short in a highlight area (lower density area) and there are problems with the reproducibility of the tone with respect to the image data. In order to resolve such problems, an electrophotographic image forming apparatus using light and dark toners having approximately the same color is disclosed in Japanese Patent Laid-Open No. 2001-290319 (corresponding to U.S. Pat. No. 6,498,910).

In ink-jet image forming apparatuses that jet liquid ink on a recording material to form images, imaging methods using dark and light ink are realized.

Although the electrophotographic image forming apparatus using light and dark toners having approximately the same color has been proposed, as described above, such an electrophotographic image forming apparatus is not manufactured because, for example, the output density of the light toner, which has an influence on the halftone of the highlight area, does not reach a desirable output density due to a change in the characteristics of the photosensitive member.

SUMMARY OF THE INVENTION

The present invention is directed to an image forming apparatus capable of achieving excellent gradation characteristics in development by using light toner and dark toner of approximately the same color and a control method of the image forming apparatus.

According to one aspect of the present invention, an image forming apparatus performing development using light toner of a first color and dark toner of the first color includes a control unit configured to control tone in order to set gradation characteristics of an image developed with the light toner; a determination unit configured to determine whether the gradation characteristics of the light toner image are in a desirable state as a result of the tone control performed by the control unit; and a shift unit configured to shift an area where mixture of the light toner with the dark toner is started, the area corresponding to the desirable state, responsive to the determination unit determining that the gradation characteristics of the light toner image are not in the desirable state.

According to another aspect of the present invention, a control method of an image forming apparatus performing development using light toner of a first color and dark toner of the first color includes the steps of controlling tone in order to set gradation characteristics of an image developed with the light toner; determining whether the gradation characteristics of the light toner image are in a desirable state responsive to the step of controlling tone; and shifting an area where mixture of the light toner with the dark toner is started, the area corresponding to the desirable state, responsive to the determining step determining that the gradation characteristics of the light toner image are not in the desirable state.

The above features are realized by any combination of the features described in the claims and the sub-claims only define exemplary embodiments of the present invention.

All the required features are not enumerated in the Summary of the Invention and any sub-combination of the features can constitute the present invention.

Further features of the present invention will become apparent from the following description of exemplary embodiments with reference to the attached drawings.

BRIEF DESCRIPTION OF THE DRAWINGS

FIG. 10 shows a voltage table, according to an embodiment of the present invention.

FIG. 15 shows a mixed-density-image data separation table, according to an embodiment of the present invention.

DESCRIPTION OF THE EMBODIMENTS

Embodiments of the present invention will be described below with reference to the attached drawings. The embodiments should not be construed as restricting the invention in the claims. All the combinations of features disclosed in the embodiments are not necessarily essential to Summary of the Invention.

Figure 1:
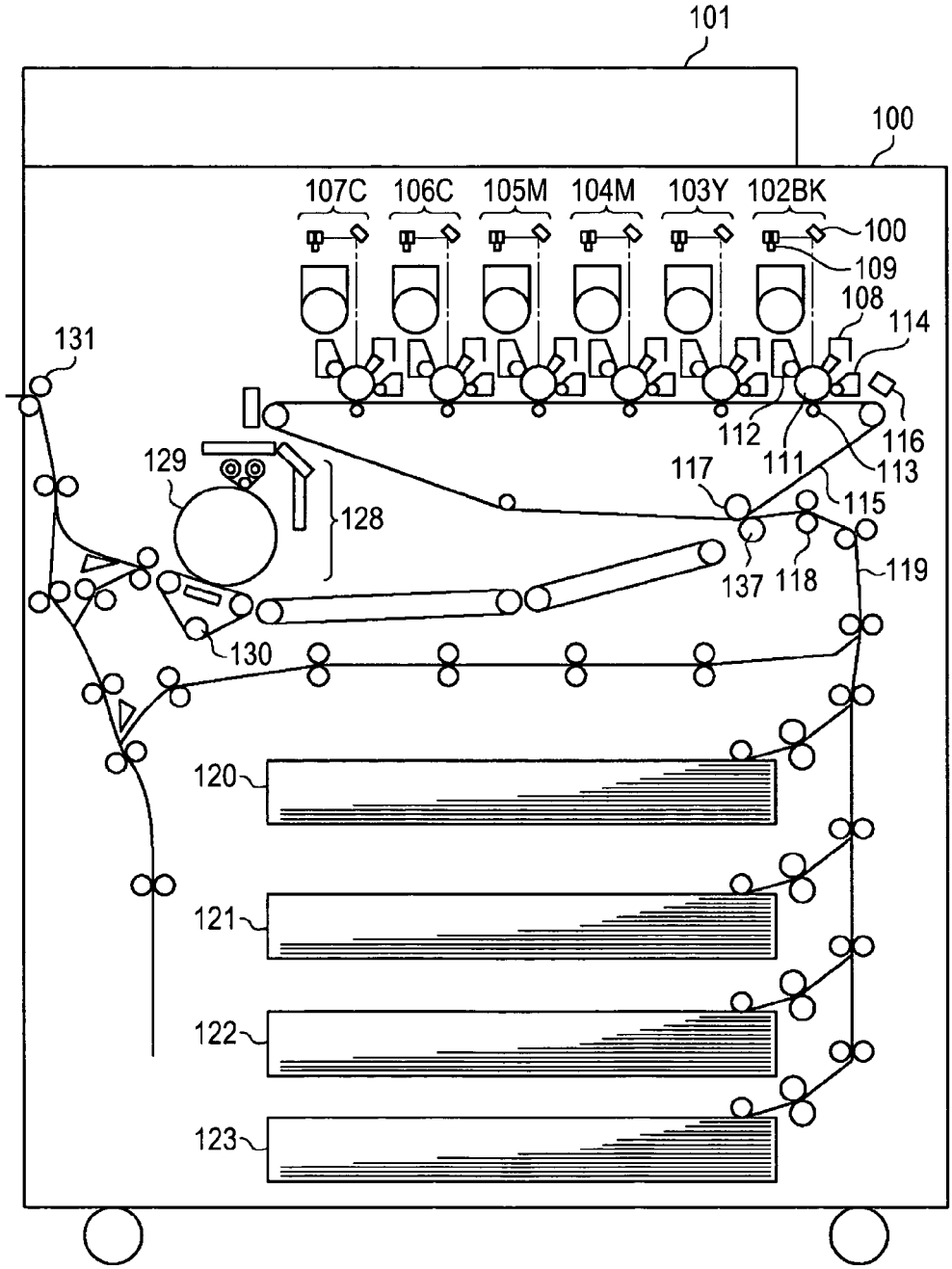
FIG. 1 is a diagram schematically showing the structure of an electrophotographic color image forming apparatus according to an embodiment of the present invention.

FIG. 1 is a diagram schematically showing the structure of an electrophotographic color image forming apparatus 100 according to an embodiment of the present invention. The color image forming apparatus 100 forms images by electrophotography using combinations of dark toner and light toner, which have appropriately the same color but have different densities.

The color image forming apparatus 100 includes six image forming units 102BK, 103Y, 104M, 105M, 106C, and 107C. The image forming unit 102BK forms black images, the image forming unit 103Y forms yellow images, the image forming unit 104M forms light magenta images, the image forming unit 105M forms dark magenta images, the image forming unit 106C forms light cyan images, the image forming unit 107C forms dark cyan images.

The toners having appropriately the same color but having different densities are equal in the spectral characteristics of coloring components (pigments) but are different in the amount of the coloring components (pigments). Resin and the coloring components (pigments) are usually included in the toner as bases. The light toner represents the toner having the relatively lower density, in one combination of the toners having appropriately the same color but having different densities.

Although the toners having approximately the same color have the same spectral characteristics of the coloring components (pigments), as described above, the toners may have different colors within a range of the same color in the usual concept of color, such as magenta, cyan, yellow, or black, instead of having exactly the same color.

According to this embodiment of the present invention, it is assumed that the light toner has an optical density of less than 1.0 after fixing when the amount of toner on a recording material is equal to 0.5 mg/cm$^2$, and that the dark toner having appropriately the same color as the light toner has an optical density of 1.0 or more after fixing when the amount of toner on the recording material is equal to 0.5 mg/cm$^2$.

In this embodiment, the amount of pigment in the dark toner is adjusted such that the optical density after fixing becomes 1.6 when the recording material has toner of 0.5 mg/cm$^2$ attached thereto. The amount of pigment in the light toner is adjusted such that the optical density after fixing becomes 0.8 when the recording material has toner of 0.5 mg/cm$^2$ attached thereto. The dark toner and the light toner are appropriately mixed to reproduce the tone of the toner of each color.

The six image forming units 102BK to 107C are arranged in a line at predetermined intervals. Each of the image forming units 102BK to 107C has a drum-type photosensitive member 111 (hereinafter referred to as a photosensitive drum) serving as an image carrier. A primary charger 108, a developing device 114, a transfer roller 113 serving as a transfer device, and a drum cleaner device 112 are provided around the photosensitive drum 111. Laser exposure devices 100 and 109 are provided under a space between the primary charger 108 and the developing device 114. Black toner, yellow toner, light-magenta toner, dark-magenta toner, light-cyan toner, and dark-cyan toner are housed in the developing device 114. An image forming operation in the color image forming apparatus 100 described above will now be described.

An image formation start signal is emitted based on image data concerning a document image read by a reader 101. The photosensitive drum 111 of each of the image forming units 102BK to 107C, the photosensitive drum 111 being rotated and driven at a predetermined processing speed in response to the image formation start signal, is uniformly and negatively charged by the primary charger 108. Laser emitting devices in the laser exposure devices 100 and 109 emit image signals, which are externally inputted and which are subjected to color separation. An electrostatic latent image of each color is formed on the photosensitive drum 111 in response to the image signals transmitted through a polygon mirror, a reflective mirror, etc.

For example, in the image forming unit 107C, the dark cyan toner is adhered to the electrostatic latent image formed on the photosensitive drum 111 by the developing device 114 to which a developing bias having the same polarity (negative polarity) as the photosensitive drum 111 is applied to form a toner image as a visual image. The dark-cyan toner image is primarily transferred to a driven intermediate transfer belt 115 by the transfer roller 113, to which a primary transfer bias (having the polarity reverse to that of the toner (positive polarity)) is applied, in a primary transfer section between the photosensitive drum 111 and the transfer roller 113.

The intermediate transfer belt 115 having the dark-cyan toner image transferred thereto moves toward the image forming unit 106C. Also in the image forming unit 106C, the light-cyan toner image formed on the photosensitive drum 111 is superimposed on the dark-cyan toner image on the intermediate transfer belt 115 and the superimposed toner image is transferred in the primary transfer section. Residual toner on the photosensitive drum 111 after the transfer is swept off and collected by a cleaner blade or the like provided in the drum cleaner device 112. Similarly, the dark-magenta toner image, the light-magenta toner image, the yellow toner image, and the black toner image, which are formed on the respective photosensitive drums 111 in the image forming units 105M, 104M, 103Y, and 102BK, respectively, are sequentially superimposed on the dark-cyan and light-cyan toner images, which are superimposed and transferred to the intermediate transfer belt 115, in the respective primary transfer sections. A full-color toner image is formed on the intermediate transfer belt 115 in the manner described above.

A transfer material (sheet of paper) is selected from paper feed cassettes 120 to 123, and the selected transfer material is fed along a feed path 119 at a timing when the tip of the full-color toner image on the intermediate transfer belt 115 moves into a secondary transfer section between a secondary transfer opposing roller 117 and a secondary transfer roller 137. The transfer material is fed into the secondary transfer section through register rollers 118. The full-color toner image is collectively and secondarily transferred to the transfer material fed into the secondary transfer section by the secondary transfer roller 137 to which a secondary transfer bias (having the polarity reverse to the toner (positive polarity)) is applied.

The transfer material on which the full-color toner image is formed is fed into a fixing device 128. The toner image is heated and pressurized in a fixing nip between a fixing roller 129 and a pressure belt 130, and the toner image is thermally fixed on the surface of the transfer material. The transfer material is then discharged on an output tray on the top surface of the main body of the color image forming apparatus 100 through output rollers 131, and the series of the image forming operation terminates.

The color image forming apparatus 100 has an automatic adjustment function of adjusting the voltages of the primary chargers 108 and the transfer rollers 113 in the image forming units 102BK to 107C in order to form an image having a higher quality. The automatic adjustment function includes Density MAX (DMAX) control for setting a maximum image density used for setting the tone of the toner image and tone correction for realizing the tone. The color image forming apparatus 100 has a patch detection sensor 116 reading the densities of patch images (refer to FIG. 8), which have a predetermined density and size and which are formed for performing the automatic adjustment function. In the automatic adjustment function, the patch detection sensor 116 reads the density of the patch image of each color and the density of the toner image developed with the toner of each color is controlled so as to become an optimal density.

Figure 2:
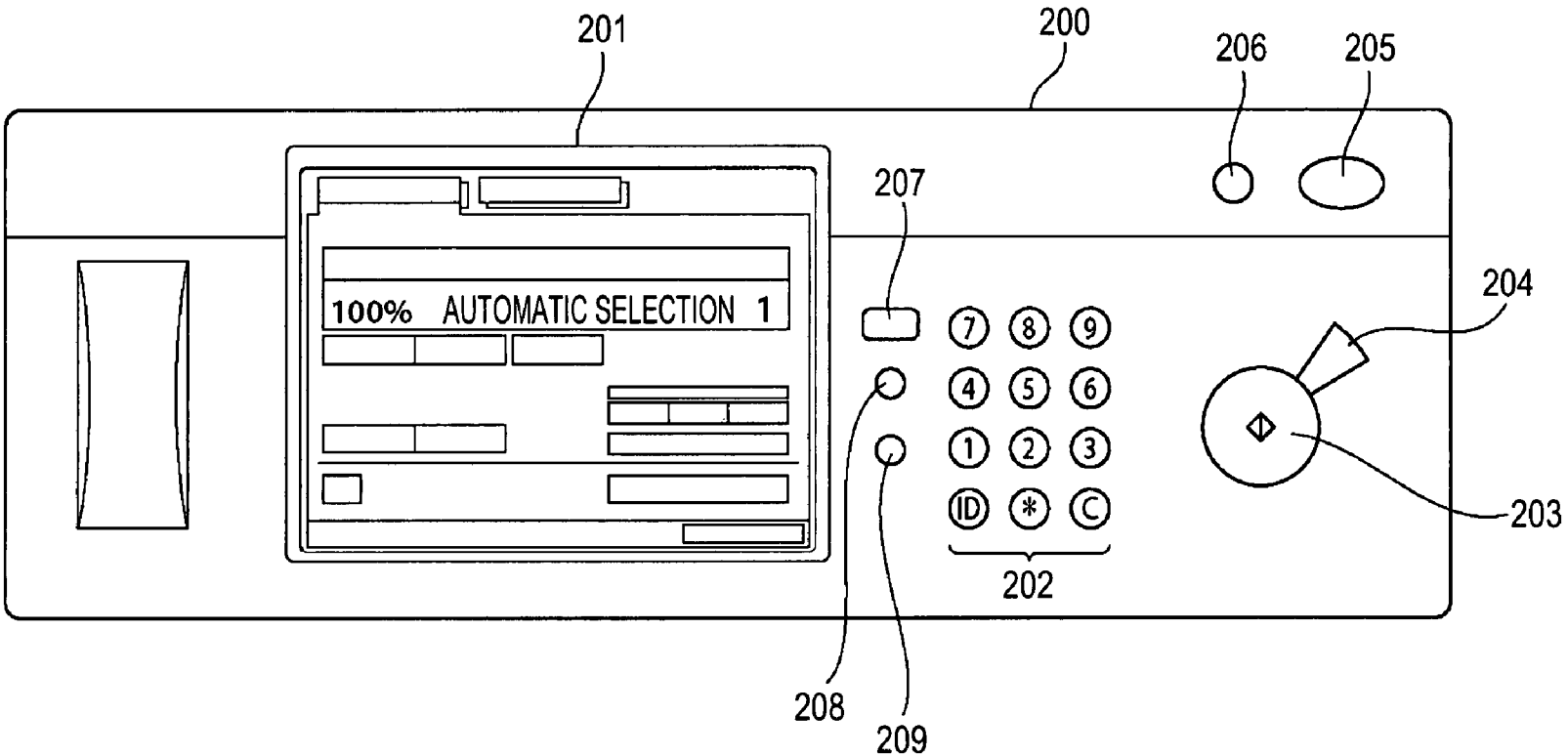
FIG. 2 is a top view of an operation panel provided on the top surface of the color image forming apparatus, according to an embodiment of the present invention.

FIG. 2 is a top view of an operation panel 200 provided on the top surface of the color image forming apparatus 100 shown in FIG. 1. The operation panel 200 has a touch-panel-type liquid crystal display (LCD) 201, with which modes of the color image forming apparatus 100 are set and conditions are displayed, and a numeric key group 202 including numeric keys used for inputting numeric characters from zero to nine and a clear key used for returning the settings to default values. A user mode key 209 is used for setting the default values of functions of the color image forming apparatus 100 and adjustment modes in which adjustments are arbitrarily performed by a user, and is also used for setting addresses of various networks, for example, the Internet protocol (IP) addresses.

A start key 203 is used for starting jobs including a copy function and a scan function. A stop key 204 is used for stopping the jobs including the copy function, a print function, and the scan function. A soft power-supply key 205 is used for stopping supply of power to, for example, a motor but sustaining the supply of the power to, for example, a central processing unit (CPU) and a network. A sleep mode key 206 is used for thermal control of the fixing device 128 in a level set with the user mode key 209.

A reset key 207 is used for resetting the functions set with the LCD 201 and the numeric key group 202 to the default values. A guide key 208 is used for displaying the description of the copy function, the print function, and the scan function set with the LCD 201 and each user mode that is displayed, set, and executed with the user mode key 209.

Figure 3:
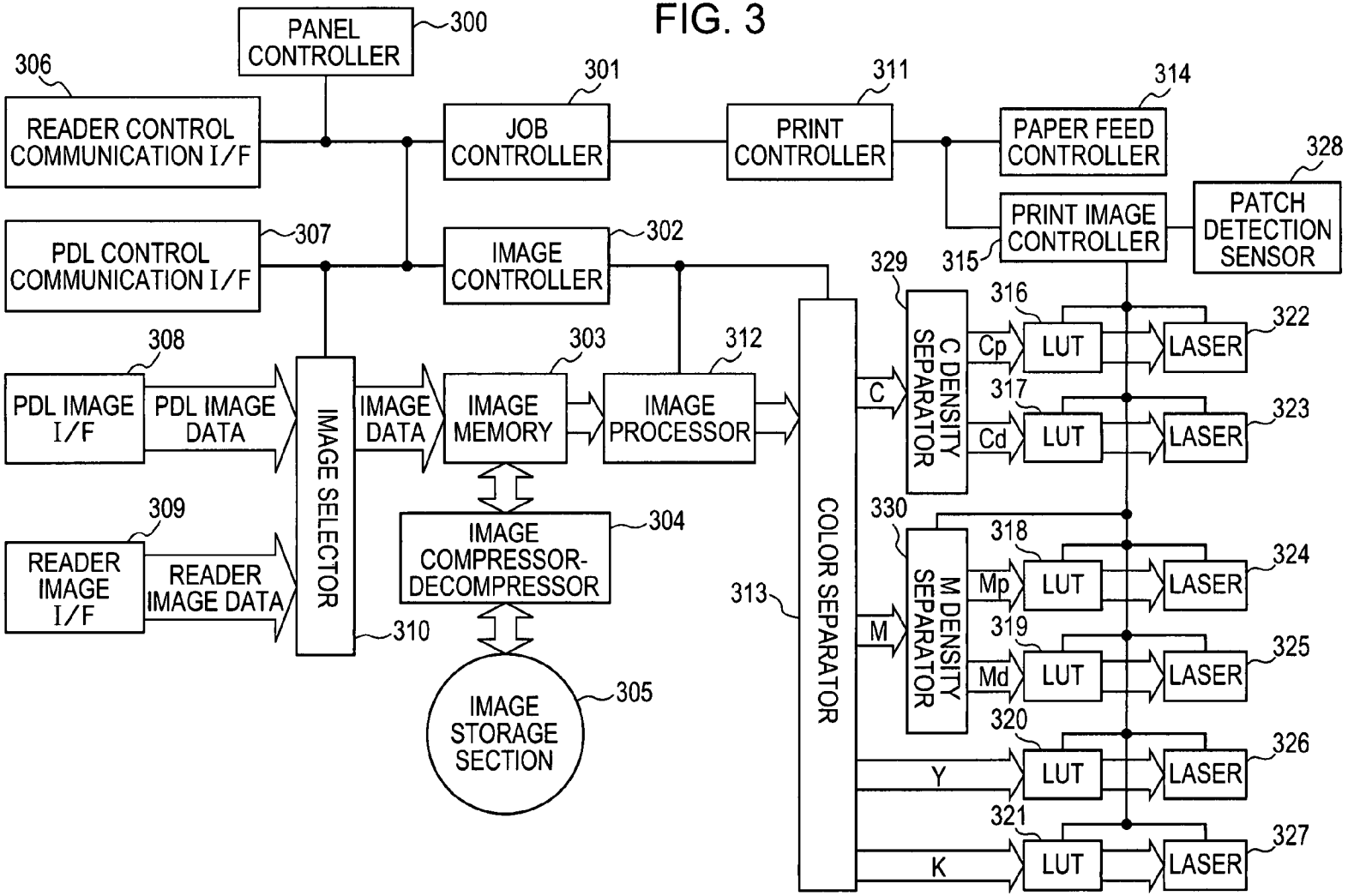
FIG. 3 is a block diagram schematically showing the structure of a control circuit in the color image forming apparatus, according to an embodiment of the present invention.

FIG. 3 is a block diagram schematically showing the structure of a control circuit in the color image forming apparatus 100 shown in FIG. 1. Referring to FIG. 3, a panel controller 300 controlling the operation panel 200 in FIG. 2 is connected to a job controller 301. The panel controller 300 monitors the operation state of the operation panel 200 under the control of the job controller 301, and transfers data and commands input with the operation panel 200 to the job controller 301.

The job controller 301 includes, for example, a read only memory (ROM) in which programs for controlling the color image forming apparatus 100 are written, a random access memory (RAM) in which the programs are expanded, and the CPU executing the programs. The job controller 301 executes the programs to create copy jobs, scan jobs, etc. based on the commands and data input with the operation panel 200.

The job controller 301, which is connected to a reader control communication I/F 306, a PDL control communication I/F 307, an image controller 302, and a print controller 311, controls the entire image forming apparatus 100. The image controller 302 is connected to the PDL control communication I/F 307, an image processor 312, and a color separator 313, in addition to the job controller 301. The image controller 302 is also connected to a PDL image I/F 308 and a reader image I/F 309 via an image selector 310. The image controller 302 controls the entire image processing in accordance with the jobs created by the job controller 301.

The reader control communication I/F 306 is a communication I/F with a CPU circuit (not shown) controlling the reader 101, which reads a document image. The reader control communication I/F 306 is controlled to receive reader image data in the control circuit through the reader image I/F 309. The PDL control communication I/F 307 is a communication I/F with the CPU circuit in a PDL image controller (not shown) expanding PDL image data transmitted from, for example, a personal computer (not shown) into a bitmap image. The PDL control communication I/F 307 is controlled to receive the PDL image data in the control circuit through the PDL image I/F 308.

The image controller 302 controls the image processing for supplying the input PDL image data and reader image data to the image forming units 102BK to 107C. The image controller 302 switches the setting of the image selector 310 to specify which image data among the PDL image data and the reader image data is to be stored in an image memory 303.

The image controller 302 performs various settings for an image compressor-decompressor 304, an image storage section 305, the image processor 312, and the color separator 313 to control the operations of these components. The image controller 302 also converts the PDL image data stored in the image memory 303 into the bitmap image data.

The image compressor-decompressor 304 compresses the bitmap image data in the image memory 303 under the control of the image controller 302, and the compressed image data is stored in the image storage section 305. The image compressor-decompressor 304 decompresses the compressed image data stored in the image storage section 305, and the decompressed image data is stored in the image memory 303. The image processor 312 reads out color image data (red (R), green (G), and black (B) image data) from the image memory 303 and performs the image processing including color balance correction (fine tuning of the color) and gamma correction.

The color separator 313 separates the R, G, and B image data subjected to the image processing in the image processor 312 into four colors: that is, cyan, magenta, yellow, and black. A cyan (C) density separator 329 further separates the cyan image data resulting from the color separation in the color separator 313 into two colors: that is, light cyan and dark cyan. A magenta (M) density separator 330 further separates the magenta image data resulting from the color separation in the color separator 313 into two colors: that is, light magenta and dark magenta.

The print controller 311 controls a paper feed controller 314 and a print image controller 315 to control the entire electrophotographic printing operation. The paper feed controller 314 controls a feeding operation of the transfer material described above. The print image controller 315 controls operations other than the feeding operation of the transfer material in the electrophotographic printing operation described above. The print image controller 315 also sets lookup tables (LUTs) 316 to 321 in which the sensitivity characteristics of the photosensitive members 111 of the image forming units 102BK to 107C for the light cyan, the dark cyan, the light magenta, the dark magenta, the yellow, and black, respectively, are reflected.

The sensitivity characteristics of the photosensitive members 111, the light exposure of lasers 322 to 327, the amount of charge in the photosensitive members 111 with the primary chargers 108, etc. are varied depending on the settings of the LUTs 316 to 321. Accordingly, when the patch images do not have desirable densities, the LUTs 316 to 321 are used to vary the image densities with respect to the input image data in order to yield the desirable densities. The densities of the patch images are detected by the patch detection sensor 328 (corresponding to the patch detection sensor 116 in FIG. 1). The control circuit includes the LUTs 316 to 321 corresponding to the image forming units 102BK to 107C, as described below in detail.

Tone Control of Density

Tone control of a mixed/combined density image, specific to this embodiment of the present invention, will be described in detail. The mixed density images exist in the two color systems, that is, in the cyan and magenta color systems, and similar tone control is performed in the two color systems. However, the following description is basically made without discriminating between the two color systems.

Figure 4:
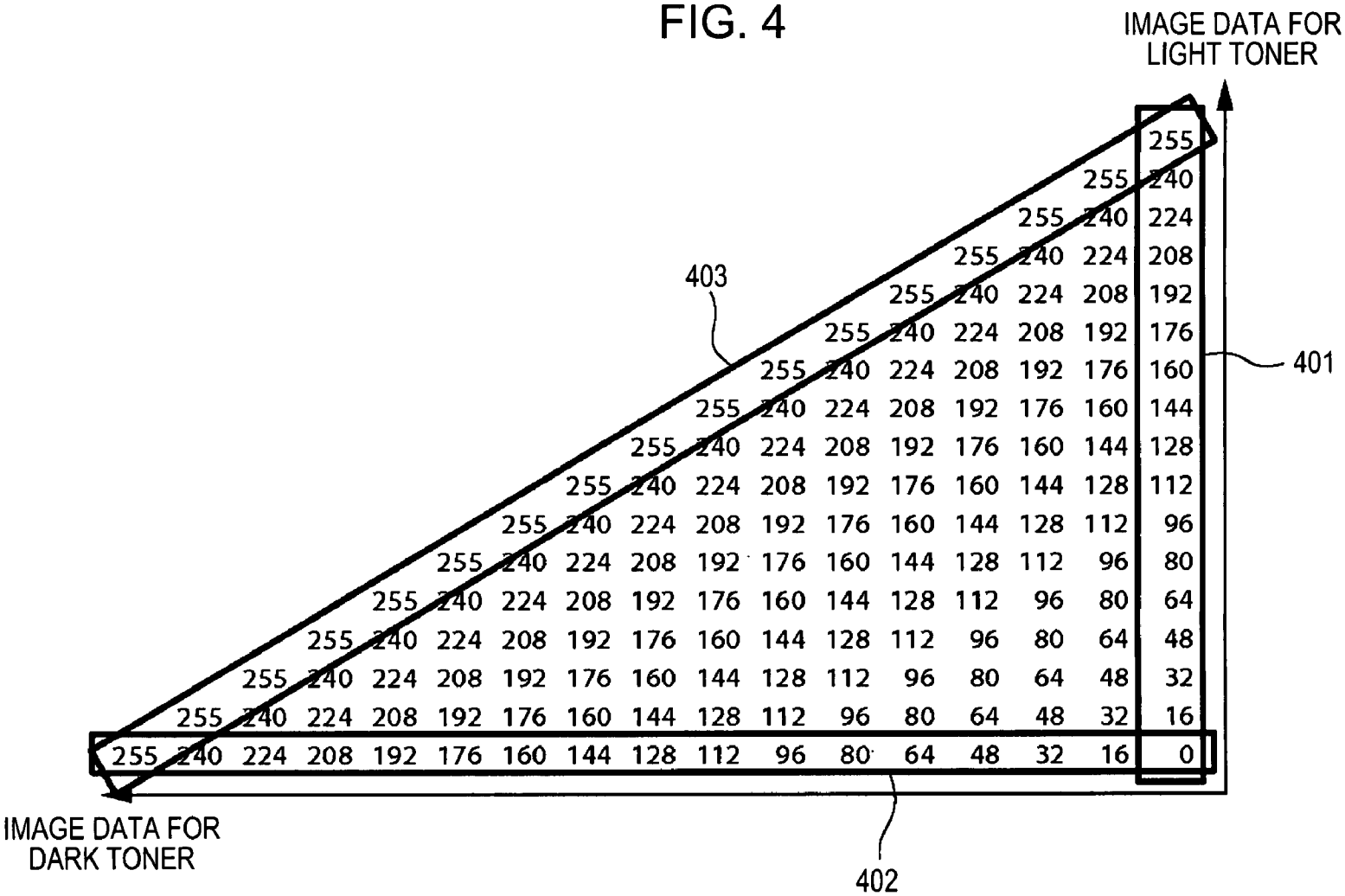
FIG. 4 shows an example table for correcting the ratio between the image data for dark toner and light toner, according to an embodiment of the present invention.

FIG. 4 shows an example table for correcting ratio between the image data for the dark toner and light toner. Referring to FIG. 4, reference numeral 401 denotes the image data for the light toner resulting from the density separation in the C density separator 329 or the M density separator 330. Reference numeral 402 denotes the image data for the dark toner resulting from the density separation in the C density separator 329 or the M density separator 330. The image data 401 and 402 belongs to the same color system.

The image forming units 102BK to 107C generate a mixed/combined density image in which the dark toner is mixed with the light toner in the same color system based on the image data 401 for the light toner and the image data 402 for the dark toner. The table for correcting the ratio between the image data for the dark toner and light toner, shown in FIG. 4, is used to correct the ratio between the image data 401 for the light toner and the image data 402 for the dark toner in order to optimize the tone of the mixed density image. The ratio between the image data for the light toner and the image data for the dark toner is mapped in the table for correcting the ratio.

In the table for correcting the ratio, the upper limit of the sum of the values of the image data 401 for the light toner and the image data 402 for the dark toner (that is, the total amount of toner in the mixed density image) is limited so as to become "255", as shown in an area 403 in FIG. 4. This is because the values of the image data are directly reflected in the amount of toner adhered to the photosensitive member 111. If the sum of the values of the image data 401 for the light toner and the image data 402 for the dark toner exceeds "255", the amount of toner on the mixed density image becomes larger than that on the images having one density (the images of the black toner and the yellow toner in this embodiment). As a result, it is highly possible that the transfer capability in the transfer of the toner image on the intermediate transfer belt 115 and the transfer material and the fixing capability of the toner image transferred to the transfer material are adversely affected. In addition, the provision of the upper limit is intended to reduce the consumption of toner.

Figure 5:
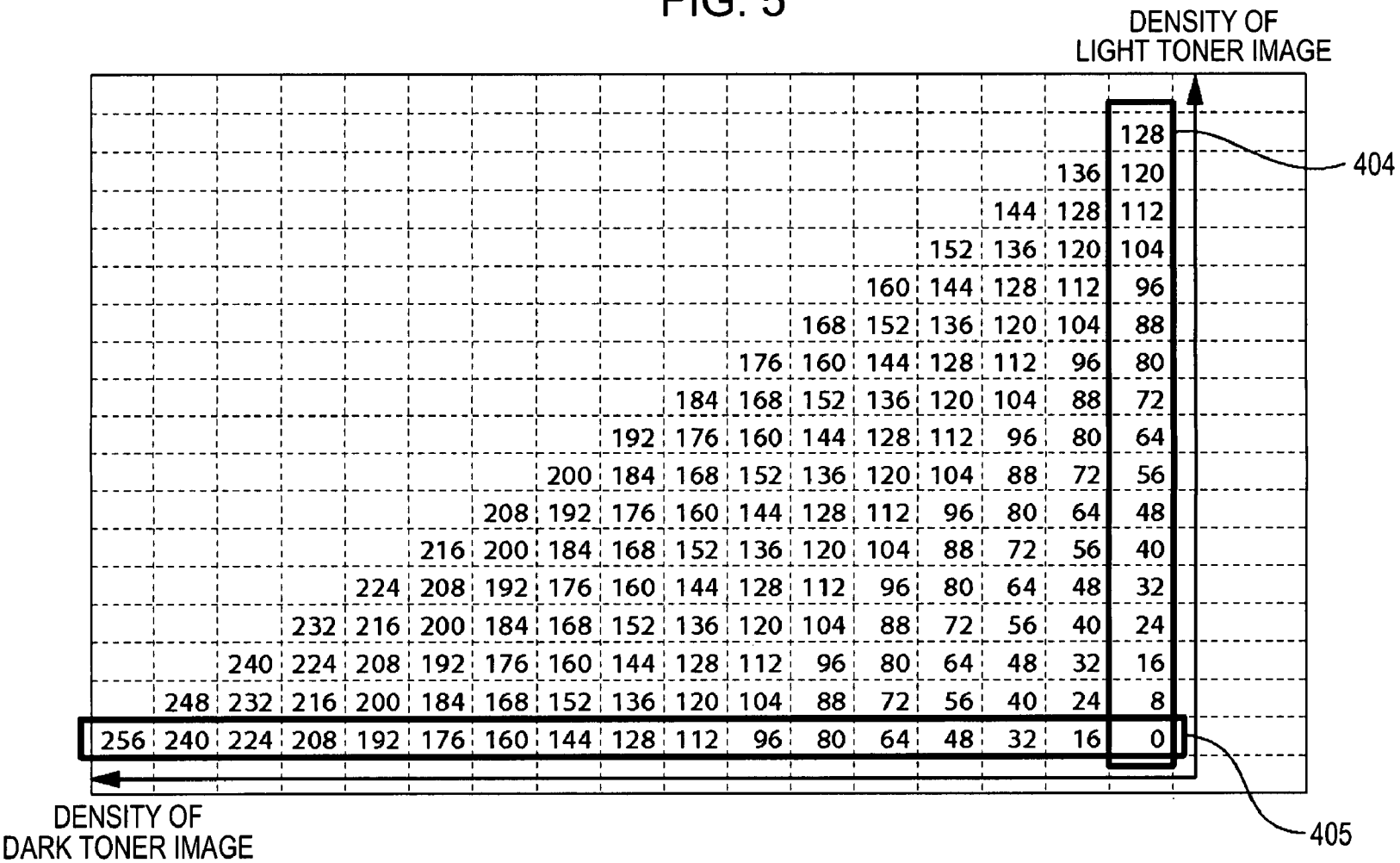
FIG. 5 shows a density table indicating the density of an image mixing the light and dark densities, according to an embodiment of the present invention.
Figure 6:
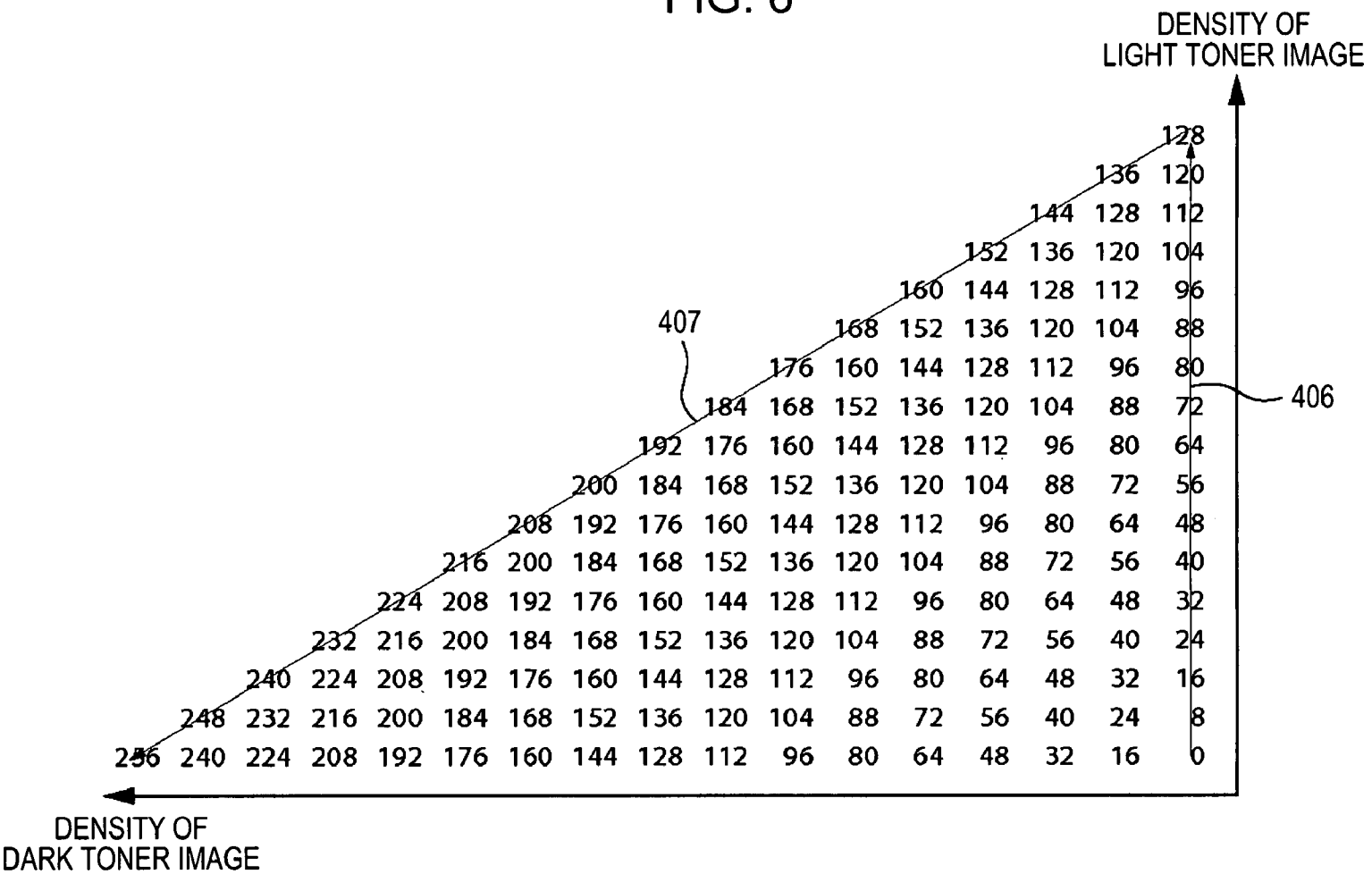
FIG. 6 shows the table indicating the density of the mixed density image, according to the embodiment of the present invention.

FIGS. 5 and 6 show a mixed-density-image density table indicating the densities of the mixed density image. It is assumed herein that the density of the light toner is half of the density of the dark toner for simplicity. Accordingly, in the table in FIG. 5, a density 405 of the dark toner image is equal to "256" when the image data 402 for the dark toner has a value of "255, whereas a density 404 of the light toner image is equal to "128", which is half of "256", when the image data 401 for the light toner has a value of "255".

According to this embodiment, in the state in which the image data 401 for the light toner has a maximum density of "128", the toner image is developed only with the light toner in an image area before the density of the light toner reaches the maximum value "128", as shown by an arrow 406 in FIG. 6. In an image area after the density of the light toner exceeds "128", the development with the dark toner is started, as shown by an arrow 407 in FIG. 6, and the toner image is developed with both the light toner and the dark toner before the density reaches "256".

Figure 7:
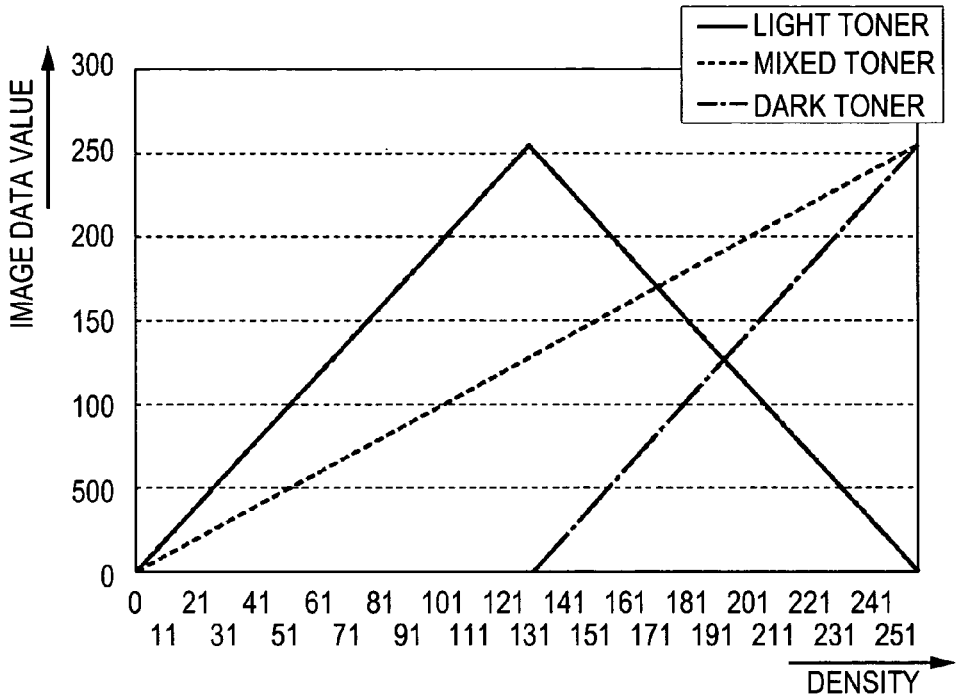
FIG. 7 is a graph showing the relationship between the image data for light toner and the image data for dark toner, according to an embodiment of the present invention.

FIG. 7 is a graph showing the relationship between the image data 401 for the light toner and the image data 402 for the dark toner in the development shown by the arrows 406 and 407 in FIG. 6. The horizontal axis represents density and the vertical axis represents image data.

Referring to FIG. 7, a solid line represents values of the light toner, a long and short dashed line represents values of the dark toner, and a broken line represents values of the mixed density toner including the light toner and the dark toner. Since the density of the light toner is half of the density of the dark toner, as described above, the value of the image data for the light toner is larger than the value of the image data for the mixed density toner at the same density.

The table for correcting the ratio between the image data for the dark toner and light toner shown in FIG. 4 and the mixed-density-image density table shown in FIG. 5 are reflected in a mixed-density-image separation table (not shown) included in the C density separator 329 and the M density separator 330.

Although the tone control of the mixed density image in the desirable state in which the image data 401 for the light toner has a maximum density of "128" is described above, the sensitivity characteristics and so on of the photosensitive members 111 in the image forming units 102BK to 107C are actually varied depending on, for example, the environment and usage of the color image forming apparatus 100. Consequently, even if the density of the light toner based on the image data 401 for the light toner is kept half of the density of the dark toner based on the image data 402 for the dark toner, the light toner does not necessarily have a maximum density of "128" when the image data 401 for the light toner has a value of "255".

Hence, the charging voltage of the photosensitive members 111, a primary transfer voltage in the transfer of the toner image to the intermediate transfer belt 115, etc. are generally varied within a predetermined range by the DMAX control in order to achieve the maximum density of the toner image.

DMAX Control

Figure 8:
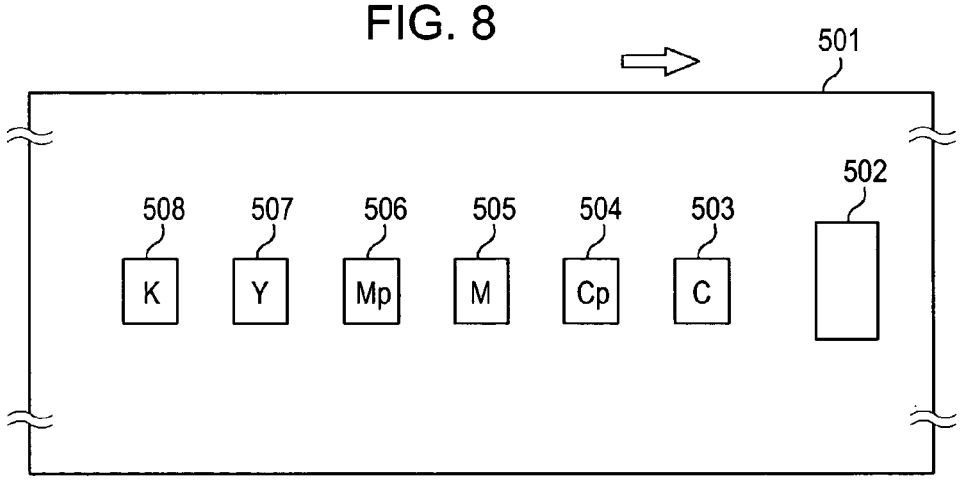
FIG. 8 is a top view illustrating an example of the structure in DMAX control, according to an embodiment of the present invention.

FIG. 8 is a top view illustrating an example of the structure in the DMAX control. In the DMAX control, the image data having a maximum tone of "255" is developed with the toners of different colors as patch images having a predetermined size, and the developed images are transferred to positions that are the same in the main scanning direction on the intermediate transfer belt 115 and that are different in the secondary scanning direction on the intermediate transfer belt 115, as shown in FIG. 8. Reference numeral 501 in FIG. 8 corresponds to the intermediate transfer belt 115 in FIG. 1, viewed from above. Reference numeral 502 corresponds to the patch detection sensor 116 in FIG. 1 and the patch detection sensor 328 in FIG. 3. The patch images of the different colors are arranged at the same position in the primary scanning direction in order to read the patch images of the different colors by the single patch detection sensor 502. The patch images of the different colors are arranged at the different positions in the secondary scanning direction in order to prevent the patch images of the different colors from overlapping with each other.

As shown in FIG. 8, the patch images 503 (C: dark cyan), 504 (Cp: light cyan), 505 (M: dark magenta), 506 (Mp: light magenta), 507 (Y: yellow), and 508 (K: black) are sequentially transferred to the intermediate transfer belt 115 in order of arrangement, and the transferred patch images are sequentially read by the patch detection sensor 502. In the DMAX control, when the output density of the patch image of one color, corresponding to the image data "255" read by the patch detection sensor 502, does not reach the maximum density "255" or exceeds the maximum density "255", output voltages from the primary chargers 108 included in the image forming units 102BK to 107C are varied, as shown in a voltage table in FIG. 10, to control the output density so as to become a desirable density.

The output voltages include charging voltages Voltage Light (VL) of the photosensitive members for the lower development density and charging voltages Voltage Dark (VD) of the photosensitive members for the higher development density.

Figure 9:
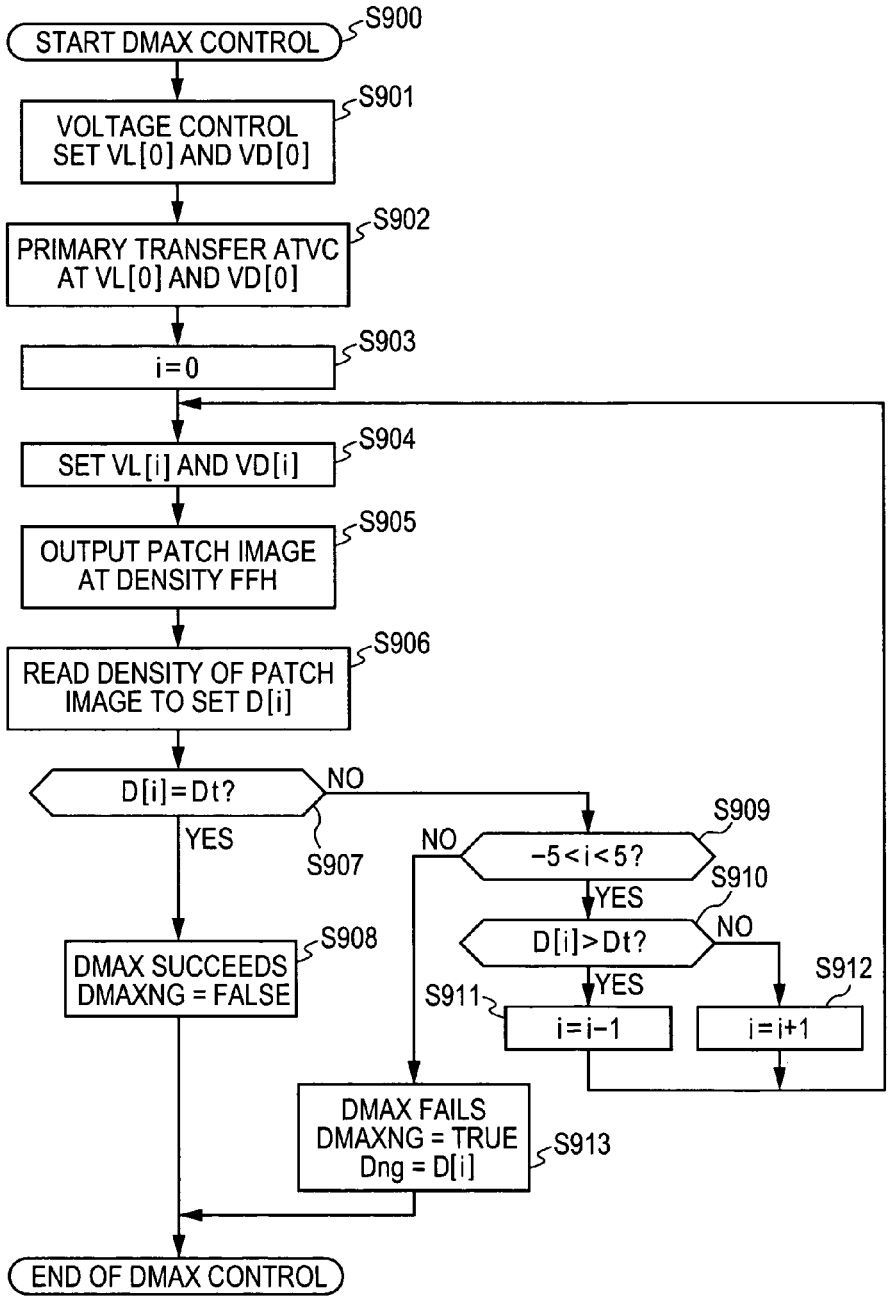
FIG. 9 is a flowchart showing the DMAX control, according to an embodiment of the present invention.

FIG. 9 is a flowchart showing the DMAX control. FIG. 10 shows a voltage table. Although the DMAX control is performed for every image forming unit of each color, the DMAX control in the image forming unit for one color is shown in FIG. 9.

In Step S900, the print image controller 315 starts the DMAX control. In Step S901, the print image controller 315 sets a reference VL[0] and a reference VD[0] by voltage control. Since the voltage control is a common method, a detailed description is omitted herein. Briefly, in the voltage control, the charging voltages are sampled at multiple points on the photosensitive member 111 to determine the output voltage and the amount of laser light of the primary charger 108, serving as a reference charger.

In Step S902, the print image controller 315 performs primary-transfer automatic transfer voltage control (ATVC) for determining a primary transfer voltage in the transfer of the image developed with the toner on the photosensitive member 111 to the intermediate transfer belt 115, by using the VL[0] and the VD[0] set in the voltage control in Step S901. After the print image controller 315 performs the primary-transfer ATVC to determine the primary transfer voltage at which the image developed with the toner is surely transferred to the intermediate transfer belt 115, then in Step S903, the print image controller 315 initializes i, which is an index used for counting the number of times of actual measurement, to "0".

If the VL[0] and the VD[0] are set to the default values in the voltage control and the primary-transfer ATVC is also set to the default value, the VD[0] and the VL[0] at i=0 in FIG. 10 are used, and the VL[0] is equal to 500V and the VD[0] is equal to 2,000V. If the VL[0], the VD[0], and the primary-transfer ATVC are not set to the default values, the print image controller 315 creates a voltage table corresponding to the voltage table in FIG. 10. The created voltage table has values given by adding the difference between the VL[0] and the VD[0], set in the voltage control in Step S901, to the values in the voltage table in FIG. 10. The print image controller 315, then, sets the added values as the values at i=0.

In Step S904, the print image controller 315 sets a VL[i] and a VD[i] to set the output voltage of the primary charger 108 again. In Step S905, the print image controller 315 forms an electrostatic latent image on the photosensitive member 111 based on the image data "255" (FFH) corresponding to the maximum density "255" ("255" for the dark magenta, the yellow, the dark cyan, and the black and "128" for the light magenta and the light cyan), develops the electrostatic latent image with the toner, and forms the toner image on the intermediate transfer belt 115 as a patch image.

In Step S906, the patch detection sensor 328 reads the density of the patch image and the print image controller 315 sets the read patch image density as D[i]. In Step S907, the print image controller 315 determines whether the patch image density D[i] becomes a desirable maximum density Dt (becomes "255" for the dark magenta, the yellow, the dark cyan, and the black or becomes "128" for the light magenta and the light cyan). If the print image controller 315 determines that the patch image density D[i] becomes the desirable maximum density Dt, then in Step S908, the print image controller 315 sets a DMAXNG flag to "FALSE" because the DMAX control succeeds.

If the print image controller 315 determines that the patch image density D[i] is different from the desirable maximum density Dt, the process proceeds to Step S909 to change the output voltage of the primary charger 108. In Step S909, the print image controller 315 determines whether the index i is larger than "−5" and less than "5" (−5>i>5). If the print image controller 315 determines that the index is −5>i>5, that is, the index is within a range in which the output voltage of the primary charger 108 is able to be controlled, then in Step S910, the print image controller 315 determines whether the patch image density D[i] is higher than the desirable maximum density Dt.

If the print image controller 315 determines that the patch image density is higher than the desirable maximum density Dt, then in Step S911, the print image controller 315 decrements the index i by one and, then, the process goes back to Step S904 to decrease a TRUE output voltage of the primary charger 108. If the print image controller 315 determines that the patch image density is lower than the desirable maximum density Dt, then in Step S912, the print image controller 315 increments the index i by one and, then, the process goes back to Step S904 to increase the output voltage of the primary charger 108.

If the print image controller 315 determines in Step S909 that the index is not −5>i>5, that is, the index is within a range in which the output voltage of the primary charger 108 is not able to be controlled, the DMAX control fails because the density correction of the toner image is performed only by controlling the output voltage of the primary charger 108 in the DMAX control. Accordingly, in Step S913, the print image controller 315 sets the DMAXNG flag to "TRUE" and stores a maximum density D[5] or D[−5] of the toner image in the failure of the DMAX control as Dng.

After the DMAX control terminates, the DMAXNG flag is set to "TRUE" (failure) or to "FALSE" (success). If the DMAXNG flag is set to "TRUE" (failure), the maximum density of the toner image is stored as the Dng.

Figure 11:
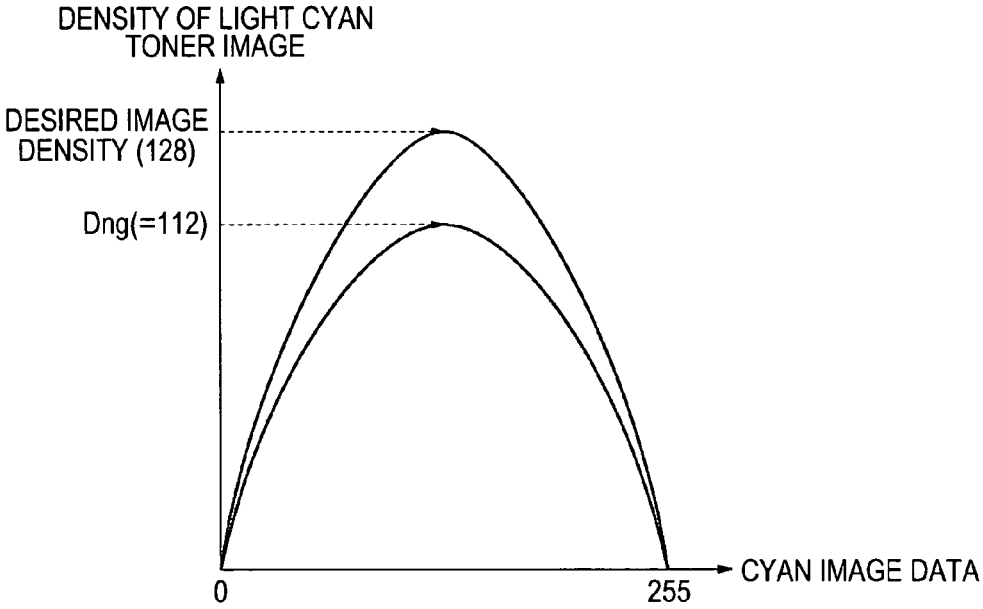
FIG. 11 is a graph showing the relationship between image data for cyan and the density of a light-cyan toner image, according to an embodiment of the present invention.

FIG. 11 is a graph showing the relationship between image data for cyan and the density of a light-cyan toner image when the DMAX control fails.

The output voltage of the primary charger 108, at which the maximum density ("128") of the light toner image can be achieved for the maximum value ("255" according to this embodiment) of the image data, is set in the DMAX control in the tone control of the density of the mixed density image. However, FIG. 11 shows that the DMAX control fails and that the maximum density Dng of the light cyan toner image reaches only "112" by the voltage control of the primary charger 108.

If the DMAX control succeeds (in the desirable state described above), the desirable maximum density is achieved in the mixed toner image and, therefore, excellent gradation characteristics are realized. In contrast, if the DMAX control fails, it may be impossible to achieve the desirable maximum density in the mixed toner image and, therefore, the excellent gradation characteristics are not realized.

Hence, the formation of the dark toner image is started at a time when the density of the light toner image is lower than "129" if the DMAX control fails, whereas the formation of the dark toner image is started at a time after the density of the light toner image becomes "129" if the DMAX control succeeds.

Figure 12:
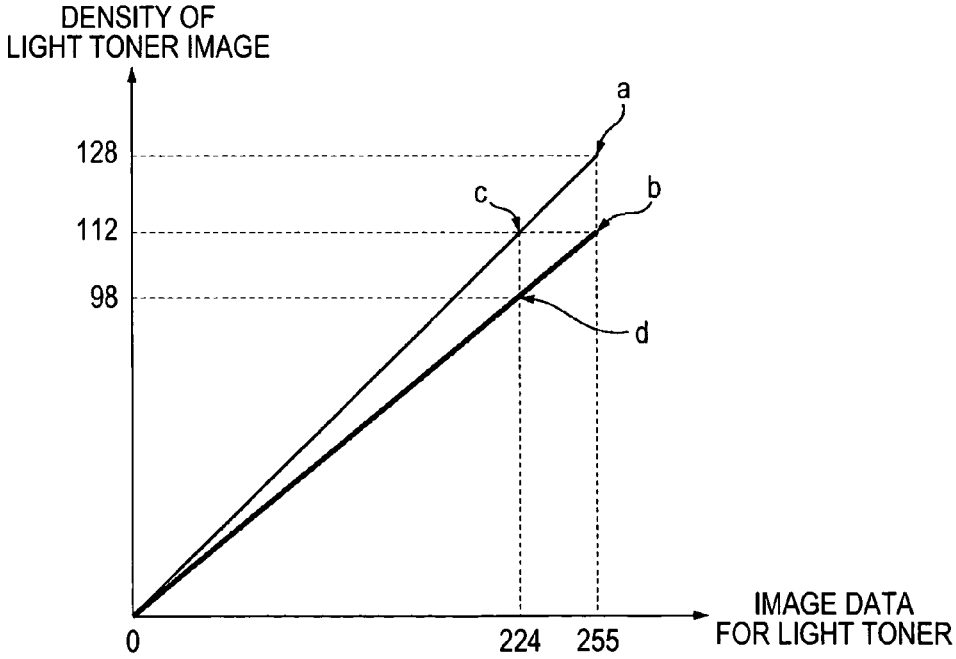
FIG. 12 is a graph showing the relationship between image data for the light toner and the density of a light toner image, according to an embodiment of the present invention.

An example of such control will be described with reference to FIG. 12. FIG. 12 is a graph showing the relationship between image data for the light toner and the density of a light toner image when the DMAX control fails. In the graph in FIG. 12, the maximum density of the light toner image reaches only "112" with the image data being equal to "255".

As shown in FIG. 12, when the image data for the light toner is equal to 255", the maximum density of the light toner image does not reach the desirable density "128" (a point a) but only reaches "112" (=Dng, a point b) and the DMAX control fails.

In this case, the formation of the mixed density image with the dark toner and the light toner is started from a point c on the graph, indicating the desirable maximum density of the light toner image corresponding to the point b, which indicates the maximum density of the light toner image when the DMAX control fails. Image data Ir at the point c where the formation of the mixed density image is started is given by the following equation:

$$Ir=255\times(Dng/128) \quad \text{[Formula 1]}$$

The real density of the light toner at the point c is equal to 98 (=Dp, a point d). The density Dp is given by the following equation:

$$Dp=Dng\times(Ir/255) \quad \text{[Formula 2]}$$

Accordingly, when the maximum density of the light toner image does not reach a predetermined value (the desirable value is "128") in the development by using the light toner and the dark toner having the same color, the development only with the light toner is performed until the image data reaches "224". After the density of the light toner image reaches the real desirable density "98", the formation of the mixed density image with both the light toner and the dark toner is started to achieve excellent gradation characteristics of the mixed density image.

In other words, when the desirable maximum density of the light toner image cannot be attained in the DMAX control for setting the gradation characteristics of the light toner, a density area where the mixture of the light toner with the dark toner is started is shifted toward lower densities (that is, toward a highlight area). This shift permits improvement of the tone reproducibility of the mixed density image with reference to the image data.

Figure 14:
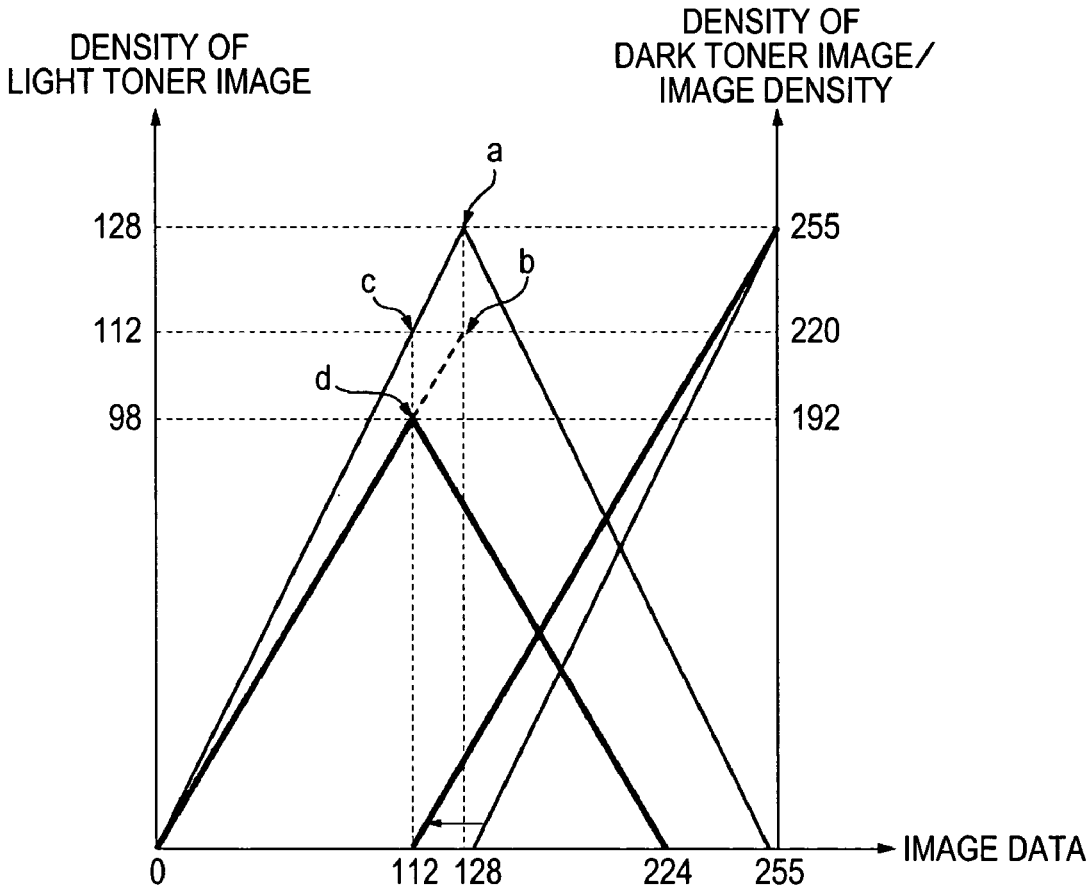
FIG. 14 is a graph showing shift of an area where the mixture of the light toner with the dark toner is started towards lower densities when a desirable maximum density of the light image is not yielded.

FIG. 14 is a graph showing the shift in association with FIG. 12. The scale of the image data represented by the horizontal axis in FIG. 14 is half of that in FIG. 12.

Figure 13:
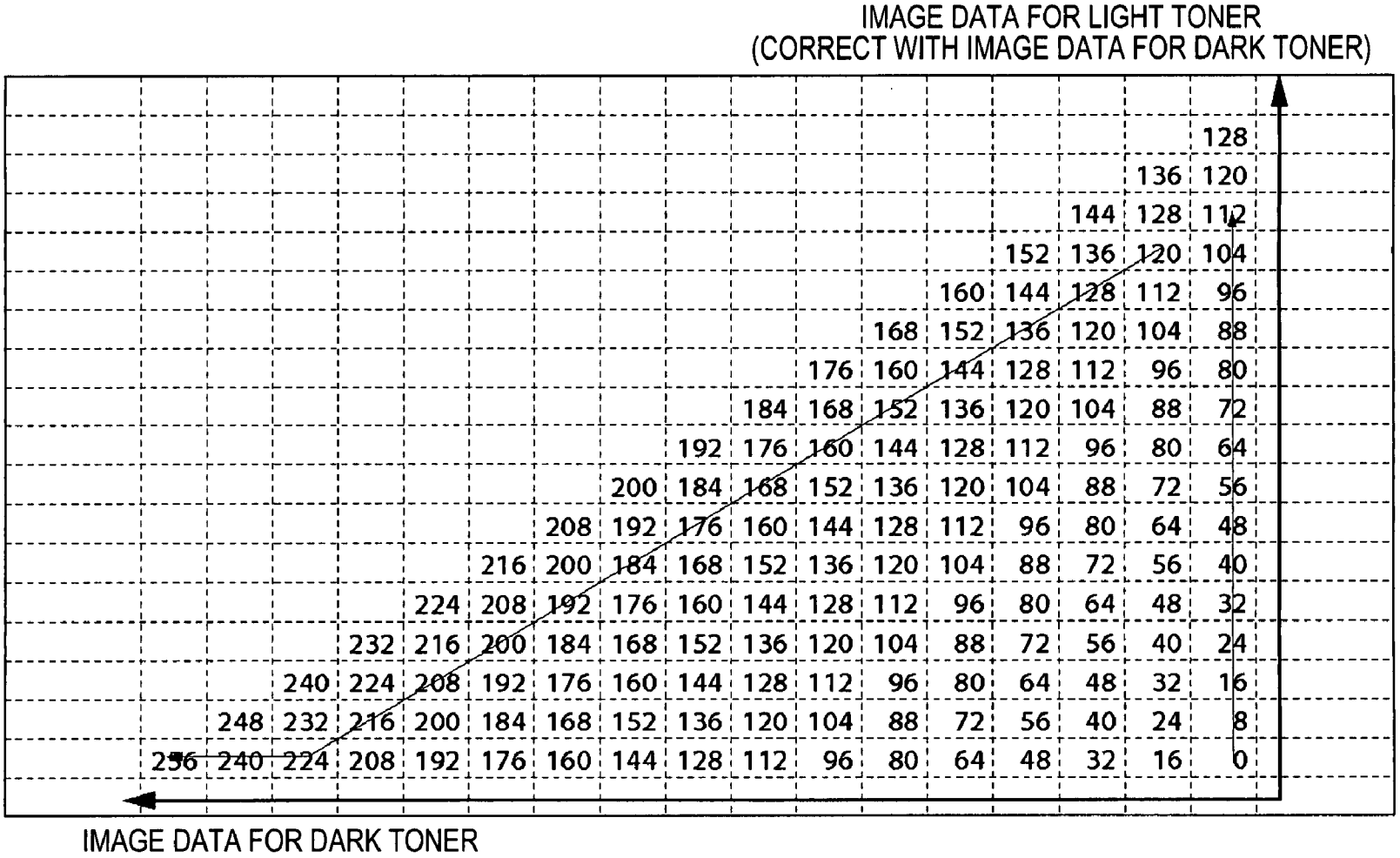
FIG. 13 shows an example of the content of a table for correcting the ratio between the image data for the dark toner and light toner.

Referring to FIG. 14, when the maximum density of the light toner image reaches the desirable value "128" in the DMAX control, the development only with the light toner is performed before the image data reaches "128". In contrast, when the maximum density of the light toner image does not reach "128" but reaches only "98", the development only with the light toner is performed only before the image data reaches "112" where the density of the light toner image is equal to the real maximum density "98". This is shown by arrows in FIG. 13.

FIG. 15 shows a mixed-density-image data separation table showing the relationship between the dark image data and the light image data for reference to the image data based on Formula 1 and Formula 2.

After performing the DMAX control, the print image controller 315 sets the mixed-density-image data separation table shown in FIG. 15 in the C density separator 329 or the M density separator 330 in FIG. 3. The print image controller 315 also sets an area where the density separation is started based on the table for correcting the ratio between the image data for the dark toner and light toner in FIG. 13.

Figure 16:
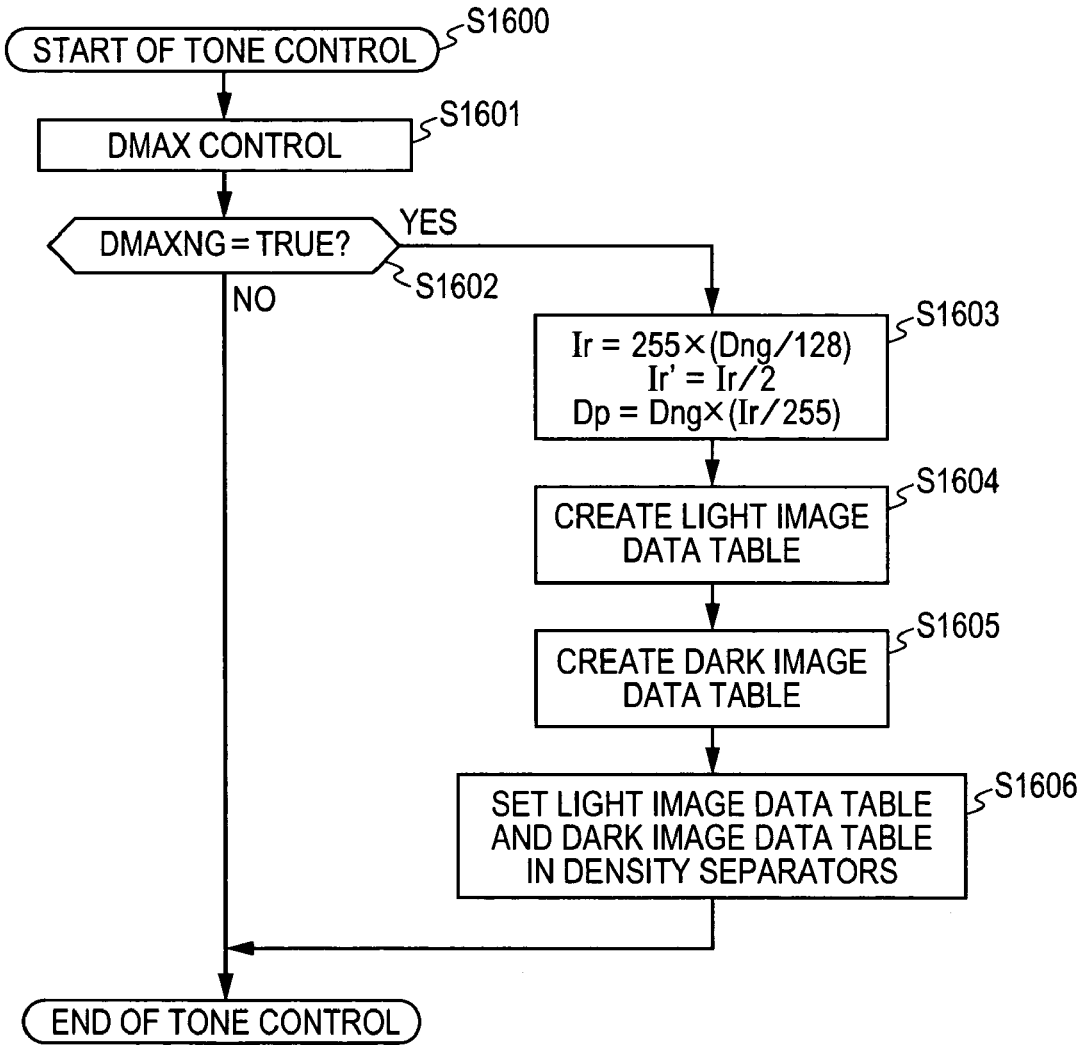
FIG. 16 is a flowchart showing a process performed by a print image controller, according to an embodiment of the present invention.

FIG. 16 is a flowchart showing a process performed by the print image controller 315.

In step S1600, the print image controller 315 receives jobs for the tone control including the DMAX control from the job controller 301 through the print controller 311. In Step S1601, the print image controller 315 performs the DMAX control described above. In Step S1602, the print image controller 315 determines whether the DMAXNG flag is set to "TRUE" as a result of the DMAX control. If the print image controller 315 determines that the DMAXNG flag is set to "TRUE", that is, if the DMAX control fails and the maximum density of the light toner image does not reach "128", then in Step S1603, the print image controller 315 corrects the density area of the mixed density image.

In the correction of the density area of the mixed density image, the print image controller 315 calculates the value of the image data Ir having a density identical to the real maximum density Dng on the assumption that the desirable maximum density is achieved, based on the real maximum density Dng of the light toner image, yielded in the DMAX control. Since the Ir is image data in the development only with the light toner, the print image controller 315 also calculates the value of image data Ir' before the density separation into the dark toner and the light toner in accordance with the ratio of density between the light toner and the dark toner.

Since it is assumed in this embodiment that (the density of the light toner)=(the density of the dark toner/2), as described above, Ir'=Ir/2. The print image controller 315 further calculates the real density Dp of the light toner corresponding to the image data Ir at the desirable maximum density in order to create the light image data table.

After calculating these values, then in Steps S1604 and S1605, the print image controller 315 creates the mixed-density-image data separation table, in FIG. 15, including light image data and dark image data. In Step S1606, the print image controller 315 sets the light image data table and the dark image data table in the C density separator 329 or the M density separator 330, and shifts the density area of the mixed density image (the image data area) where the density separation is to be performed.

Although the correction of the density area of the mixed density image in the tone control (the DMAX control), in which the maximum density of the light toner image is set, is described above, it is possible to perform similar correction of the density area of the mixed density image in other tone control.

Other tone control includes DHALF control for setting levels of halftone. Briefly, when the halftone image density detected in the DHALF control does not reach a desirable image density, the area where the mixture of the light toner with the dark toner is started is shifted towards the highlight area based on the amount of shift in the halftone image density.

For example, it is desirable for the density of the light toner image to reach "64" when the value of the image data of the light toner is equal to "128". However, when the real output density Dng is equal to "56", substituting "128" and "64" for the real image data and the desirable image density, respectively, in Formula 1 in the DMAX control provides the same result as in the DMAX control, that is, Ir=128×(56/64)=112.

The patch images for different densities may be generated with the light toner to control the gradient (the gradation characteristics) of the densities of the multiple patch images, the densities being detected by a sensor, so as to be identical to a desirable gradient (gradation characteristics) of the densities of the multiple patch images, without performing the DMAX control and the DHALF control. If the desirable gradation characteristics are not achieved in this control, the area where the mixture of the light toner with the dark toner is started may be shifted towards the highlight area based on the amount of shift between gradation characteristics closest to the desirable gradation characteristics achieved in the above control and the desirable gradation characteristics.

Furthermore, it is necessary to perform the detection of the patch images multiple times in the DMAX control and the DHALF control. However, the detection of patch images that are performed multiple times can adversely affect the productivity of the image forming apparatus. Accordingly, one patch image of the light toner may be formed between print images during the execution of print jobs, the formed patch image may be detected, and the detected patch image may be reflected in the mixed-density-image density table.

In such detection of the patch image, if at least one patch image is detected between the print images, the density of the patch image can be measured and the parameters in Step S1603 in FIG. 16 can be calculated. In addition, the light image data table in Step S1604 and the dark image data table in Step S1605 can be generated. Consequently, it is possible to correct the mixed density image data during the execution of the print jobs and, therefore, the productivity of the image forming apparatus is not reduced.

As described above, according to the embodiments of the present invention, the development with the dark toner and the light toner in the same color system allows the tone reproducibility of the highlight area with respect to the image data to be ensured. In addition, the correction with the dark toner is performed even if the maximum density of the light toner does not reach a desirable density because of the deterioration of the photosensitive material, so that the halftone reproducibility is kept stable.

Since the data area of the mixed density image can be corrected by a simple process, for example, by measuring the densities of the patch images of the light toner in any tone control, it is possible to prevent a reduction in the productivity while keeping the halftone reproducibility even in a print job having much number of copies.

The present invention is not restricted to the above embodiments. For example, the present invention is applicable not only to the case where the light toner and dark toner in two approximately the same color systems are used but also to the case where the light toner and dark toner in three or more approximately the same color systems are used.

The present invention can be embodied by supplying a storage medium (or a recording medium) having the program code of software realizing the functions according to the above embodiments to a system or an apparatus, the computer (or the CPU or the micro processing unit (MPU)) in which system or apparatus reads out and executes the program code stored in the storage medium.

In this case, the program code itself read out from the storage medium realizes the functions of the embodiments described above. The present invention is applicable to the storage medium having the program code stored therein.

The computer that executes the readout program code realizes the functions of the embodiments described above. In addition, the operating system (OS) or the like running on the computer may execute all or part of the actual processing based on instructions in the program code to realize the functions of the embodiments described above.

Alternatively, after the program code read out from the storage medium has been written in a memory that is provided in an expansion board included in the computer or in an expansion unit connected to the computer, the CPU or the like in the expansion board or the expansion unit may execute all or part of the actual processing based on instructions in the program code to realize the functions of the embodiments described above.

The above program may be any program capable of realizing the functions according to the embodiments in a computer. For example, the above program may be an object code, a program executed by an interpreter, or script data supplied to the OS.

The storage medium supplying the program may be any storage medium, such as a random access memory (RAM), a non-volatile RAM (NVRAM), a floppy disc®, an optical disk, a magneto-optical disc (MO), a compact disc-read only memory (CD-ROM), a compact disc recordable (CD-R), a compact disc rewritable (CD-RW), a digital versatile disc (DVD) (a DVD-ROM, a DVD-RAM, a DVD-RW, and a DVD+RW), a magnetic tape, a nonvolatile memory card, or another ROM, which is capable of storing the above program. Alternatively, the above program may be downloaded from another computer or database (not shown) over the Internet, a commercial network, or a local area network.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-336153 filed Nov. 19, 2004, which is hereby incorporated by reference herein in its entirety.

What is claimed is:

1. An image forming apparatus including an image forming unit configured to form an image, using light toner and dark toner of which a density is higher than a density of the light toner in a same color system, by starting mixing the light toner with the dark toner at a signal level of image data, the signal level being equal to or higher than a predetermined signal level of the image data, the image forming apparatus comprising:

a density detection unit configured to detect a density of a pattern image formed with the light toner without using the dark toner; and a control unit configured to control image forming conditions of the image forming unit in such a manner that the density of the pattern image detected by the density detection unit is equal to a target density of the pattern image, wherein the control unit changes the predetermined signal level to a lower signal level when the detected density of the pattern image does not obtain the target density even if the image forming conditions are controlled.

2. A control method of an image forming apparatus including an image forming unit configured to forming an image, using light toner and dark toner of which a density is higher than a density of the light toner in a same color system, by starting mixing the light toner with the dark toner at a signal level of image data, the signal level being equal to or higher than a predetermined signal level of the image data, the control method comprising:

detecting a density of a pattern image formed with the light toner without using the dark toner;

controlling image forming conditions in such a manner that the density of the pattern image detected in the detecting step is equal to a target density of the pattern image; and changing the predetermined signal level to a lower signal level when the detected density of the pattern image does not obtain the target density of the pattern image even if the image forming conditions are controlled in the controlling step.

* * * * *